US006606812B1

(12) United States Patent
Gwinn, Jr.

(10) Patent No.: US 6,606,812 B1
(45) Date of Patent: Aug. 19, 2003

(54) FIREARM BARREL CHANGE APPARATUS

(76) Inventor: Mack W. Gwinn, Jr., P.O. Box 61, Stetson Rd., Levant, ME (US) 04456

( * ) Notice: Subject to any disclaimer, the term of this patent is extended or adjusted under 35 U.S.C. 154(b) by 0 days.

(21) Appl. No.: 10/167,665

(22) Filed: Jun. 13, 2002

(51) Int. Cl.[7] ..... F41A 21/48
(52) U.S. Cl. ..... 42/75.02
(58) Field of Search ..... 42/75.01, 75.02, 42/75.04

(56) References Cited

U.S. PATENT DOCUMENTS 761,463 A * 5/1904 Fay
2,345,127 A * 3/1944 Kehne
2,345,833 A * 4/1944 Schirokauer
2,455,608 A * 12/1948 Rosengren
3,183,617 A * 5/1965 Ruger et al.
3,417,499 A * 12/1968 Allyn
3,464,136 A * 9/1969 Wilhelm
3,961,436 A * 6/1976 Hagen et al. ..... 42/17
5,540,008 A * 7/1996 Kirnstatter ..... 42/75.02

FOREIGN PATENT DOCUMENTS

| | | | | |
|---|---|---|---|---|
| CH | 221 962 | * | 9/1942 | ..... 42/75.02 |
| DE | 184 189 | * | 5/1907 | ..... 42/75.02 |
| DE | 1 703 549 | * | 8/1973 | ..... 42/75.02 |
| EP | 155 356 | * | 9/1985 | |

* cited by examiner

*Primary Examiner*—Stephen M. Johnson
(74) *Attorney, Agent, or Firm*—Michael W. York

(57) ABSTRACT

Firearm barrel change apparatus for a firearm having a receiver and a barrel with a portion configured to slide into the receiver. The firearm barrel change apparatus also includes a barrel receiving nut having provisions for slidably receiving the inner portion of a firearm barrel and a barrel retention member. The barrel retention member has a portion thereof sized and shaped to cooperate with the barrel receiving nut to lock the firearm barrel to the receiver. A special handguard assembly is also provided that allows the barrel retention member to be used with the barrel receiving nut without removing the handguard assembly.

15 Claims, 2 Drawing Sheets

FIREARM BARREL CHANGE APPARATUS

BACKGROUND OF THE INVENTION

Firearms with barrels that are removable without the need to use special barrel changing equipment such as a barrel wrench and a barrel vise have been in use for a number of years. Sporting firearms with this feature, such as take down firearms, have been popular since they allow a firearm to be broken down into two relatively small packages for transportation purposes and then be readily assembled by the shooter when it is desired to use the firearm. Unfortunately, this type of firearm requires that the receiver and the barrel of the firearm be designed with take down features and this increases the complexity of the firearm. Also, in many cases firearms with this take down feature are not as accurate as rigid firearms without this feature.

Systems that will permit the barrel to be changed have been used in the past for machine guns in an attempt to take care of the barrel heating problem caused by the rapid firing of cartridges in the machine gun barrel. When a cartridge is fired in a firearm barrel powder is burned and this produces heat that is partly transferred to the firearm barrel. With a non-automatic type firearm, sufficient time exists between shots that this heat is partially dissipated and hence heating of the firearm barrel is not a problem. However, with an automatic weapon there is insufficient time between shots for the heat to be dissipated and hence the amount of heat build up in the barrel can cause the barrel to become too hot for the proper functioning of the weapon. Such barrel changing systems for machine guns have required that the machine gun be specifically designed with this barrel change feature and that the receiver be designed for this feature. This of course increases the complexity of the firearm. Both this barrel change system and the previously mentioned take down system use the same configuration of barrels and associated equipment.

In many instances it is highly desirable to have a firearm that can readily utilize different types of barrels. This is particularly true of military type firearms since they can be used in different situations where a different type of barrel would be necessary or desirable. For instance, for accurate long range shooting a relatively long heavy barrel would be desirable and a short light weight barrel would be desirable for close range shooting in a confined area. Many barrels came with provisions for attaching additional equipment such as a wide variety of sights, grenade launchers, etc. and it is desirable to change barrels to mount barrels that already have particular types of equipment to the receivers rather-:.than having to mount the equipment to the barrel.

While it is possible to make such barrel changes, it can not normally be done at the using unit level since special barrel changing equipment is necessary. In addition, in the case of the U.S. Military M-16 type weapon, barrel changes can damage the aluminum receiver of the firearm. Consequently, frequent barrel changes of the M-16 type weapons should be avoided.

Consequently, although there have been barrel change firearm systems in the past such as the take down firearms and the machine gun barrel change systems, these have not been useful in providing a barrel change system that readily permits one receiver that has no barrel change provisions to be used with a variety of different types of barrels and equipment attached to the barrels.

SUMMARY OF THE INVENTION

This invention relates to firearms with changeable barrels and more particularly to firearms with readily changeable barrels.

Accordingly, it is an object of the invention to provide firearm barrel change apparatus that increases the effectiveness of the firearm.

It is an object of the invention to provide firearm barrel change apparatus that permits the firearm to be used in a variety of roles.

It is an object of the invention to provide firearm barrel change apparatus that permits one firearm to be used with a variety of different types of barrels.

It is an object of the invention to provide firearm barrel change apparatus that permits one firearm to be used with a variety of different types of barrels and attached equipment.

It is an object of the invention to provide firearm barrel change apparatus that permits one firearm to be used with a variety of different types of barrels and attached equipment without removing the equipment from the barrel.

It is an object of the invention to provide firearm barrel change apparatus that requires no modification to the basic firearm.

It is an object of the invention to provide firearm barrel change apparatus that uses a standard receiver.

It is an object of the invention to provide firearm barrel change apparatus that uses standard barrels.

It is an object of the invention to provide firearm barrel change apparatus that can be used to retrofit standard firearms.

It is an object of the invention to provide firearm barrel change apparatus that is easy to use to retrofit standard firearms.

It is an object of the invention to provide firearm barrel change apparatus that avoids damaging the receiver.

It is an object of the invention to provide firearm barrel change apparatus that avoids possible damage to firearms with aluminum receivers.

It is an object of the invention to provide firearm barrel change apparatus that maintains the accuracy of the firearm when the barrel is changed.

It is an object of the invention to provide firearm barrel change apparatus that does not require the removal of the handguard in order to change the barrel.

It is an object of the invention to provide firearm barrel change apparatus that uses a handguard that allows access to remove the barrel from the receiver.

It is an object of the invention to provide firearm barrel change apparatus that uses a handguard that only touches the barrel at its breech end.

It is an object of the invention to provide firearm barrel change apparatus that permits barrels to be changed without special tools.

It is an object of the invention to provide firearm barrel change apparatus for military use that permits barrels to be readily changed at the local unit level.

It is an object of the invention to provide firearm barrel change apparatus that is easy to use by the person using the firearm.

It is an object of the invention to provide firearm barrel change apparatus that requires very little training to use.

It is an object of the invention to provide firearm barrel change apparatus that is simple in its operation.

It is an object of the invention to provide firearm barrel change apparatus that has few parts.

It is an object of the invention to provide firearm barrel change apparatus that can be manufactured with the use of altered existing parts.

It is an object of the invention to provide firearm barrel change apparatus that is particularly useful with firearms having aluminum receivers.

It is an object of the invention to provide firearm barrel change apparatus that is particularly useful with firearms in which the surfaces for the bolt locking lugs are not part of the receiver.

It is an object of the invention to provide firearm barrel change apparatus that is particularly useful for firearms that use firearm barrels where the surfaces for the bolt locking lugs are attached to or form part of the barrel structure.

It is an object of the invention to provide firearm barrel change apparatus that is particularly useful with the M16 type firearms.

These and other objects of the invention will become apparent from the following described firearm barrel change apparatus for a firearm having a receiver and a barrel with a portion configured to slide into the receiver. The firearm barrel change apparatus includes a barrel receiving nut having provisions for slidably receiving a barrel retention member and a barrel retention member having a portion thereof sized and shaped to cooperate with said barrel receiving nut to lock the barrel to the receiver. A special handguard assembly is also provided that allows the barrel retention member to be used with the barrel receiving nut without removing the handguard assembly. A handguard extension assembly is also provided that can be added to the handguard assembly when longer barrels are attached to the receiver.

BRIEF DESCRIPTION OF THE DRAWINGS

The invention will be hereinafter more fully described with reference to the accompanying drawings in which.

DETAILED DESCRIPTION OF THE PREFERRED EMBODIMENT

Figure 1:
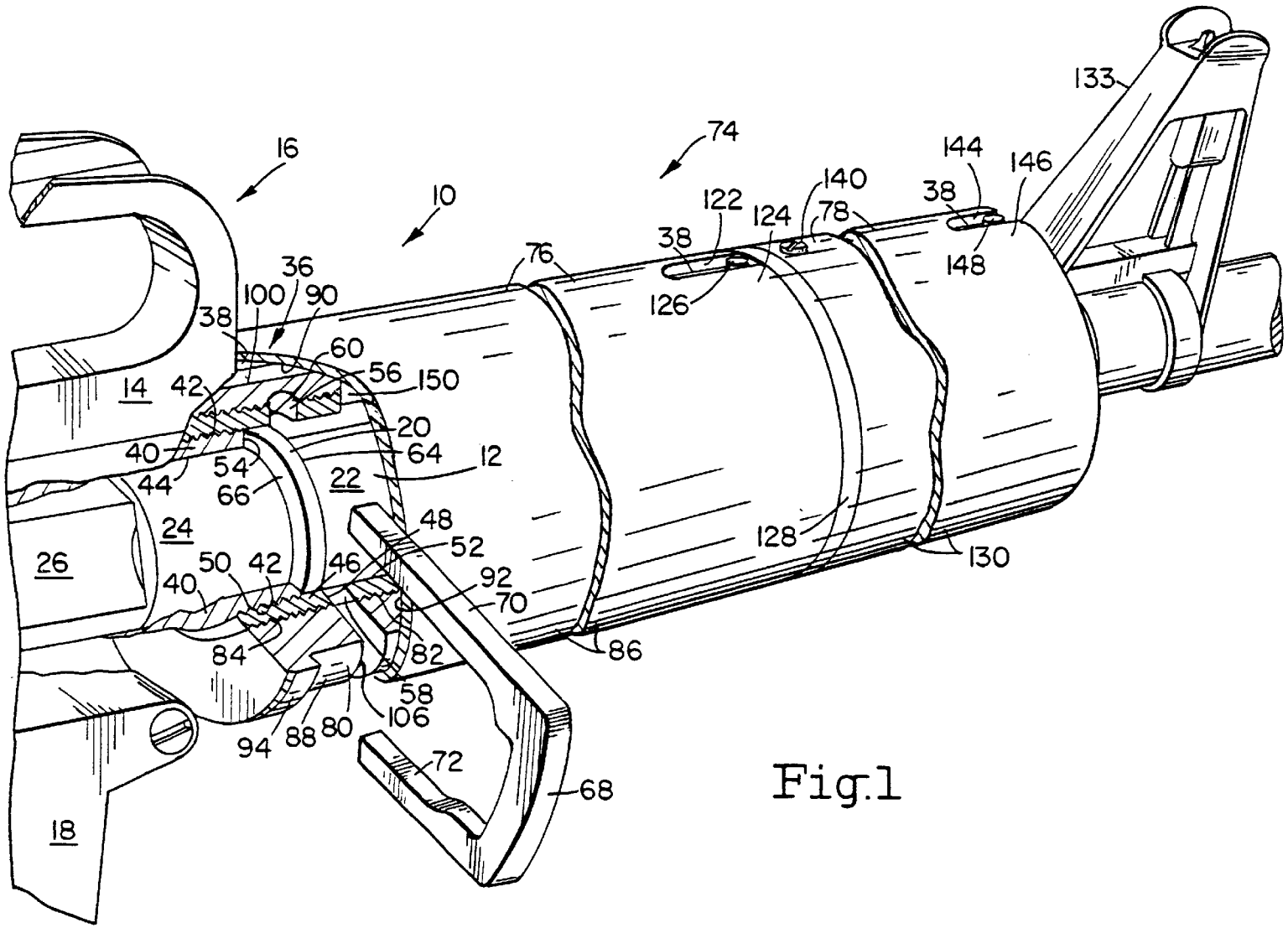
FIG. 1 is a perspective view of the firearm barrel change apparatus invention installed on an M-16 type firearm with certain portions thereof broken away for clarity.
Figure 2:
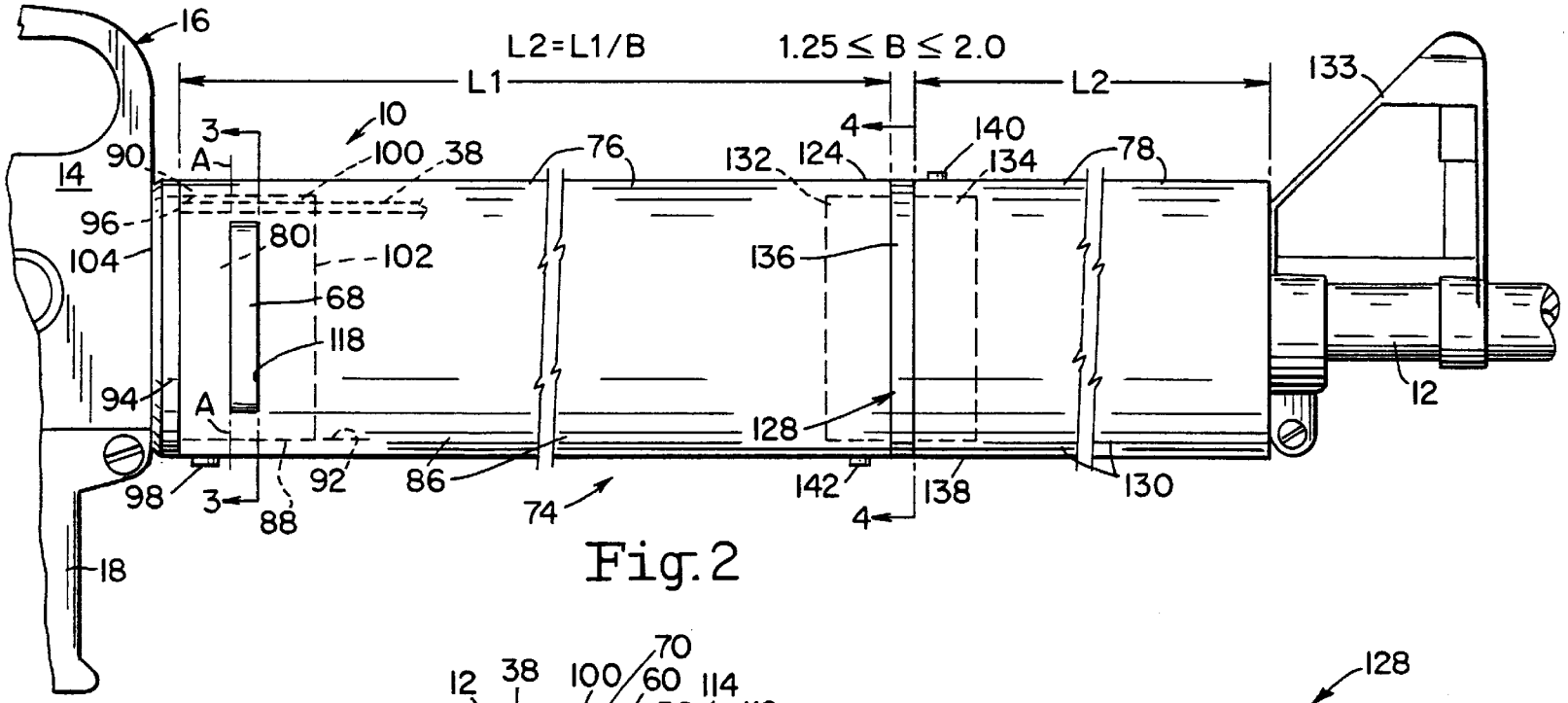
FIG. 2 is a side elevational view of the structure illustrated in FIG. 1.
Figure 4:
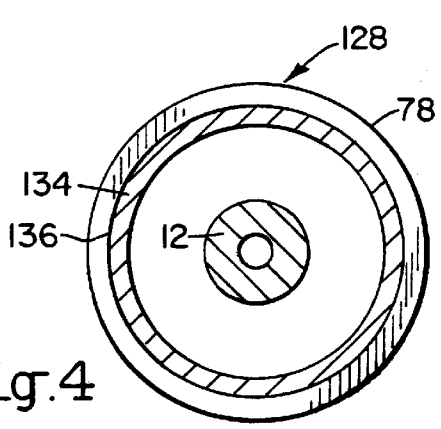
FIG. 4 is a sectional view of the firearm barrel change apparatus invention illustrated in FIG. 2 taken in the direction of the line 4—4 thereof.
Figure 3:
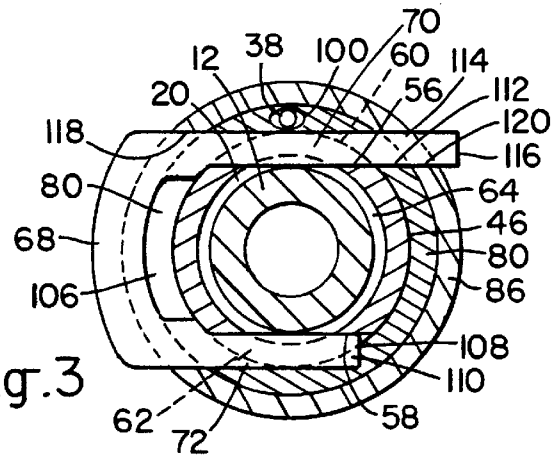
FIG. 3 is a sectional view of the firearm barrel change apparatus invention illustrated in FIG. 2 taken in the direction of the line 3—3 thereof.

FIGS. 1, 2 and 3 illustrate the firearm barrel change apparatus invention 10 and associated conventional barrel 12 located in the upper receiver 14 of a conventional M-16 type firearm 16. It should be noted that for ease of illustration that certain portions of the M-16 type firearm 16 that are not necessary for a proper understanding of the invention have been omitted. As illustrated, the conventional M-16 type firearm 16 with its upper receiver 14 and its lower receiver 18 is entirely conventional and is not modified. The same is true with the barrel 12 including its conventional retention flange 20 that projects circumferentially outward from the rear or breech end 22 of the barrel 12 and the adjacently located conventional barrel extension 24. The M-16 type firearm 16 also is illustrated with a conventional bolt carrier assembly 26. The conventional barrel 12 is also connected to an an associated conventional gas system 36 including a conventional gas tube 38.

The upper receiver 14 has the conventional cylindrical circular cross section projection 40 on its forward end and this projection 40 has a standard threaded outer surface 42 and a standard circular shaped cross section hole 44 that is sized and shaped to slidably accept the barrel extension 24 on the breech end 22 of the barrel 12. Normally a conventional barrel nut (not shown) would be placed over the barrel 12 and pushed to the rear end 22 of the barrel 12 so that it pushed against the retention flange 20 and then it would be threaded onto the threaded outer surface 42 on the projection 40 to secure the barrel 12 to the upper receiver 14. As indicated previously, unfortunately the conventional barrel nut requires expert knowledge and tools that are not readily available to enable the barrel 12 to be installed in the upper receiver 14.

Consequently, this firearm barrel change apparatus invention 10 replaces the conventional barrel nut with a unique barrel receiving nut 46. This barrel receiving nut 46 has a generally cylindrical shape with a circular cross section shaped hole 48 that has threads 50 on the portion that is is adapted to be located closest to the upper receiver 14 that are sized and shaped to match and engage with the threads on the threaded outer surface 42 of the projection 40 on the upper receiver 14.

The outer portion 52 of the hole 48 in the barrel receiving nut 46 is unthreaded and is sized and shaped to receive the rear or breech end 22 of the barrel 12 including slidably receiving the barrel retention flange 20 which is normally pushed up against the end 54 of the projection 40 on the forward end of the upper receiver 14. The barrel receiving nut 46 has upper and lower rectangular slots 56 and 58 in it that are oppositely located and are located to have the rearward surfaces 60 and 62 of the respective slots 56 and 58 be located so that they are on the same plane A as the front or outer surface 64 of the barrel retention flange 20 when the breech end 22 of the barrel 12 is firmly pushed into the hole 48 in the barrel receiving nut 46 so that the rear surface 66 of the retention flange 20 is pushed up against the end 54 of the projection 40 on the forward end of the upper receiver 14.

In addition to the barrel receiving nut 46, the firearm barrel change apparatus 10 includes a barrel retention member 68 that has an upper projection 70 and a lower projection 72 that are sized and shaped to slide into the respective upper and lower slots 56 and 58 in the barrel receiving nut 46. When the upper and lower projections 70 and 72 are in place in the respective slots 56 and 58 in the barrel receiving nut 46, the barrel 12 is securely connected to the upper receiver is since the projections 70 and 72 have portions that bear against the front or outer surface 64 of the barrel retention flange 20 and hence prevent forward movement of the barrel 12 with respect to the barrel receiving nut 46 that is in turn connected to the upper receiver 14.

The firearm barrel change apparatus 10 also includes a handguard assembly that is designated generally by the number 74. The handguard assembly 74 in turn comprises a main handguard assembly 76 and a handguard extension assembly 78. The main handguard assembly 76 comprises a generally cylindrical shaped handguard bushing 80 that has a generally hollow circular cross section. The handguard bushing 80 has a centrally located threaded hole 82 that is sized and has threads that match threads 84 that are located on the outer surface of the barrel receiving nut 46 so that the handguard bushing 80 can be secured to the barrel receiving nut 46 by screwing it onto the barrel receiving nut 46. The main handguard assembly 76 also comprises a hollow circular cross section handguard tube 86. The handguard bushing 80 has a recessed cylindrical outer surface portion 88 that is sized and shaped to slide into the end portion 90 of the circular cross section hole 92 in the handguard tube 86. The handguard bushing 80 also has an enlarged greater diameter end flange portion 94 located adjacent to the recessed outer surface portion 88 and this flange portion 94 closes the inner opening 96 of the circular cross section hole 92 of the handguard tube 86. The handguard tube 86 is secured to the handguard bushing 80 by conventional means such as conventional screws represented by the screw 98 in FIG. 2.

The handguard bushing 80 has an aperture 100 extending through it from its forward surface 102 to its rearward surface 104 that is sized and shaped to slidably receive the gas tube 38. In this connection, the cross section of the aperture 100 for the gas tube 38 is oblong shaped as illustrated in FIG. 3 and this permits minor lateral deviations in the position of the gas tube 38 as the barrel 12 is being connected to the upper receiver 14.

The handguard bushing 80 also has an elongated vertically oriented slot 106 in the bushing 80 that is located, sized and shaped to receive the barrel retention member 68 when the projections 70 and 72 are inserted into the slots 56 and 58 in the barrel receiving nut 46. In this connection, it should be noted that there is an cut out portion 108 in the opposite wall of the bushing 80 that is sized and shaped to receive the outer end portion 110 of the lower projection 72 of the barrel retention member 68 and there is also a rectangular shaped aperture 112 in the opposite wall of the handguard bushing 80 that is sized and shaped to receive the outer end portion 114 of the upper projection 70 of the barrel retention member 68 so that the outer end portion 116 of the upper projection 70 extends outside of the handguard bushing 80 when the barrel retention member 68 is in its fully seated locking position as illustrated in FIG. 3.

As best illustrated in FIGS. 2 and 3, since the portion 88 of the handguard bushing 80 is covered by the inner end portion 90 of the handguard tube 86, the inner end portion 90 of the handguard tube 86 has an elongated vertically oriented slot 118 that is substantially identical in shape to the slot 106 and is located to coincide with the slot 106 in the handguard bushing 80. In addition, as indicated in FIGS. 2 and 3, the inner end portion 90 of the handguard tube 86 has a rectangular shaped aperture 120 that is located and sized to coincide with the rectangular shaped aperture 112 in the wall of the handguard bushing 80. These apertures 118 and 120 in the inner end portion of the handguard tube 86 allow the barrel retention member 68 to be inserted into the handguard bushing 80 and the barrel receiving nut 46 to secure the barrel 12 to the upper receiver 14.

It will be appreciated that the handguard assembly 76 of the firearm barrel change apparatus 10 is the free floating type since the handguard assembly 76 does not touch the barrel at any point other than through the barrel receiving nut 46. As a consequence, the M-16 type firearm 16 that uses this handguard assembly 76 should have better accuracy than the same M-16 type firearm with a conventional handguard assembly. In addition, the handguard tube 86 has an elongated slot 122 extending through its upper surface in the forward end 124 of the handguard tube 86. This slot 122 permits access to a gas adjustment fitting 126, if there is one connected to the gas tube 38, so that the gas flow in the gas tube 38 can be regulated by the user without removing the main handguard assembly 76.

Since barrels 12 come in several lengths depending upon the anticipated use for the barrel 12 and the associated M-16 type firearm 16, the firearm barrel change apparatus invention 10 also has provisions for being used conveniently with different length barrels 12. In this connection, the handguard extension assembly 78 is used when the M-16 type firearm 16 is to be used with a long barrel 12.

The handguard extension assembly 78 comprises a handguard extension bushing 128 and an associated handguard extension tube 130. The handguard extension bushing 128 has a hollow circular shaped cross section with inner and outer identical cylindrical lip portions 132 and 134 that are separated by a larger diameter thin circular shaped flange portion 136. The inner lip portion 132 is sized and shaped to slide into the inside of the outer or forward end portion 124 of the handguard tube 86. The handguard extension tube 130 is substantially the same shape as the previously described main handguard tube 86 and it has substantially the same cross section. However, the length L2 of the handguard extension tube is substantially less than the length L1 of the handguard tube 86. It has been determined that $L2=L1/B$ where $1.25 \leqq B \leqq 2.0$ and in the preferred embodiment B is substantially equal to 1.5. As indicated in FIG. 2, the lengths L1 and L2 sould be sufficient to substantially cover the entire barrel 12 from the upper receiver 14 to the front sight assembly 133.

Since the outer lip portion 134 of the handguard extension bushing 128 is identical to the inner lip portion 132 that is sized and shaped to slide into the inside of the outer end portion 124 of the handguard tube 86, the outer lip portion 134 is sized and shaped to slide into the inside of the inner end portion 138 of the handguard extension tube 130 that has the same cross section as the handguard tube 86. The inner end portion 138 of the handguard extension tube 130 is secured to the outer lip portion 134 of the handguard extension bushing 128 by conventional means such as by screws 140 (only one of which is shown in FIG. 2) that extend through the inner end portion 138 of the handguard extension tube 130 into the outer lip portion 134 of the handguard extension bushing 128. The larger diameter flange portion 136 of the handguard extension bushing 128 has the same outside diameter as the outside diameter of the handguard tube 86 and the handguard extension tube 130. When the handguard extension assembly 78 is in use, it is secured to the outer end portion 124 of the handguard tube 86 by conventional means such as by screws 142 (only one of which is shown in FIG. 2) that extend through the outer end portion 124 of the handguard tube 86 into the inner lip portion 132 of the handguard extension bushing 128.

As illustrated in FIG. 1, in a manner similar to the previously described handguard tube 86, the handguard extension tube 130 has an elongated slot 144 extending through its upper surface in the forward end 146 of the handguard extension tube 130. This slot 144 permits the user of the firearm 16 to have access to a gas adjustment fitting 148, if there is one connected to the gas tube 38, so that the gas flow in the gas tube 38 can be regulated by the user without removing the handguard extension assembly 78.

The firearm barrel change apparatus invention 10 is manufactured in the following manner. The firearm barrel change apparatus invention 10 is made from conventional materials using conventional machining techniques known in the firearms manufacturing industry. In order to keep the firearm barrel change apparatus invention 10 light in weight, a suitable grade of aircraft aluminum is used for its parts where possible. In this connection, the handguard tube 86 and the handguard extension tube 130 are manufactured from aircraft grade aluminum tubing using conventional techniques known in the art. The handguard bushing 80 is manufactured by conventional machining techniques known in the art from suitable aircraft grade aluminum stock as is the handguard extension bushing 128. The barrel receiving nut 46 and the barrel retention member 68 are manufactured using conventional techniques known in the art from a suitable grade of steel such as 4140 chrome moly for strength. The assembly of the components of the firearm barrel change apparatus invention 10 is conventional and is obvious to those skilled in the art.

The firearm barrel change apparatus invention 10 is used in the following manner. The firearm barrel change apparatus invention 10 can be used as part of an originally manufactured M-16 type firearm 16 or it can be used to retrofit an M-16 type firearm 16 that has a standard system of attaching the barrel 12 to the upper receiver 14. In either situation the user of the M-16 type firearm 16 operates and fires the firearm in a conventional manner as it was used prior to the installation of the firearm barrel change apparatus 10. However, with the firearm barrel change apparatus 10, due to the free floating handguard assembly 74, the firearm will usually shoot more accurately.

If the firearm barrel change apparatus 10 is added to the M-16 type firearm 16 at the time of the original manufacture of the firearm 10, the conventional barrel nut (not shown) is not installed. In its place the barrel receiving nut 46 is installed on the existing threaded outer surface 42 on the projection 40 on the upper receiver 14. To accomplish this a wrench of the type known in the art is used by inserting projections on the wrench into two installation slots 150 (only one of which is shown in FIG. 1) that are located opposite each other in the outer end of the barrel receiving nut 46. The wrench is then turned to turn the barrel receiving nut 46 to install it on the projection 40 on the upper receiver 14.

If the M-16 type firearm 16 is retrofitted with the firearm barrel change apparatus 10, the standard conventional barrel nut is removed after removing the standard handguards, etc. and the firearm barrel 12 is also removed. The barrel receiving nut 46 is then installed by threading it onto the outer threaded surface 42 on the projection 40 of the upper receiver 14 using the previously described wrench and the slots 150 in the barrel receiving nut 46. Then to install the firearm barrel 12 of the desired configuration and length, the handguard assembly 74 is connected to the barrel receiving nut 46 by threading the handguard bushing 80 onto the threads on the outer surface of the barrel receiving nut 46 making sure that the aperture 100 in the handguard bushing 80 is aligned with the corresponding hole for the gas tube 38 in the upper receiver 14.

Then the breach end of the barrel 12 of the desired configuration and length is inserted into the receiving nut 46 and at the same time the end of the gas tube 38 is inserted into the aperture 100 in the handguard bushing 80 and into the upper receiver 14. When the barrel 12 and the associated gas tube 38 are properly seated, the barrel retention member 68 is inserted into the slot 118 in the handguard tube 86 and the adjacent slot 106 in the handguard bushing 80 with the upper projection 70 and the lower projection 72 going into the slots 118 and 106 so that the upper projection 70 enters the rectangular shaped aperture 112 in the opposite wall of the handguard bushing 80 and the adjacent rectangular shaped aperture 120 in the wall of the handguard tube 86. At the same time, the lower projection 72 is positioned so that its outer end portion 110 enters the cut out portion 108 in the opposite wall of the handguard bushing 80. With the barrel retention member 68 in this position, the barrel 12 is securely connected to the upper receiver 14 of the M-16 type firearm since the projections 70 and 72 have portions that bear against the outer surface of the barrel retention flange 20 and portions that are located in the slots 56 and 58 of the barrel receiving nut 46 that is secured to the upper receiver 14. Then the M-16 type firearm with the newly installed barrel 12 and associated handguard assembly 74 is used in a conventional manner.

When it is desired to change the barrel 12, pressure is applied to the outer end portion 114 of the upper projection 70 of the barrel retention member 68 toward the barrel 12 by tapping with a blunt instrument or the like. This will cause the barrel retention member 68 to be forced out of the elongated slots 106 and 118 in the handguard bushing 80 and tube 86 and the free the barrel 12 from the upper receiver 14. Then when another barrel 12 is to be connected to the upper receiver 14, the process set forth above is repeated. If the barrel 12 is long, then the handguard extension assembly 78 is connected to the main handguard assembly 76 in the previously indicated manner prior to inserting the barrel 12 into the barrel receiving nut 46.

As used herein the designation M-16 type of firearm includes but is not limited to the M-16, M-16A1, M-16A-2, M-16A-3, M-4, C7, C8, AR-15, AR-10, AR-10A1 and similar type firearms with various military and commercial designations.

Although the invention has been described in considerable detail with reference to certain preferred embodiments, it will be understood that variations or modifications may be made within the spirit and scope of the invention as defined in the appended claims.

What is claimed is:

1. Firearm barrel change apparatus for a firearm having a receiver and a barrel having a barrel portion configured to slide into the receiver and having a barrel retaining portion comprising: insertable barrel retention means for retaining the barrel portion configured to slide into the receiver in said receiver, a barrel receiving member having connecting means for connecting said barrel receiving member to said receiver, said barrel receiving member having an aperture for receiving the barrel portion configured to slide into the receiver and the barrel retaining portion and having means for slidably receiving at least a portion of said insertable barrel retention means, said insertable barrel retention means having a portion thereof sized and shaped to cooperate with said barrel receiving member and the barrel retaining portion to lock said barrel to said receiver, and a handguard assembly secured to said barrel receiving member having a portion thereof with a passage from the exterior thereof configured to permit passage of the portion of said insertable barrel retention means sized and shaped to cooperate with said barrel receiving member and the barrel retaining portion to lock said barrel to said receiver into and out of the means for slidably receiving at least a portion of said insertable barrel retention means of said barrel receiving member without removing said handguard assembly.

2. The firearm barrel change apparatus of claim 1 wherein the portion of said insertable barrel retention means sized and shaped to cooperate with said barrel receiving member and the barrel retaining portion to lock said barrel to said receiver comprises at least one projection.

3. The firearm barrel change apparatus of claim 2 wherein the barrel retaining portion of said barrel comprises a flange and the at least one projection of said insertable barrel retention means is adapted to bear against the flange.

4. The firearm barrel change apparatus of claim 3 wherein the means for slidably receiving at least a portion of said insertable barrel retention means of said barrel receiving member comprises at least one slot and the at least one projection of said insertable barrel retention means is is sized and shaped to slide into the at least one slot.

5. The firearm barrel change apparatus of claim 4 wherein the barrel portion configured to slide into the receiver has a barrel extension.

6. The firearm barrel change apparatus of claim 1 wherein said handguard assembly comprises a handguard bushing and a hollow handguard tube secured to the handguard bushing.

7. The firearm barrel change apparatus of claim 6 wherein said handguard assembly is secured to said barrel receiving member through the handguard bushing.

8. The firearm barrel change apparatus of claim 7 wherein said firearm also has a gas tube associated with said barrel and wherein said handguard assembly has means for receiving a portion of said gas tube.

9. The firearm barrel change apparatus of claim 8 wherein said handguard assembly has means for permitting access to a gas adjustment fitting without removing said handguard assembly if a gas adjustment fitting is connected to said gas tube.

10. The firearm barrel change apparatus of claim 9 wherein said means for permitting access to a gas adjustment fitting without removing said handguard assembly if a gas adjustment fitting is connected to said gas tube comprises an opening in the hollow handguard tube of said handguard assembly.

11. The firearm barrel change apparatus of claim 8 further comprising a handguard extension assembly adapted to be connected to said handguard assembly.

12. The firearm barrel change apparatus of claim 11 wherein said handguard extension assembly comprises a handguard extension bushing and a hollow handguard extension tube secured to the handguard extension bushing and wherein said handguard extension assembly is adapted to be connected to said handguard assembly through the handguard extension bushing.

13. The firearm barrel change apparatus of claim 12 wherein said handguard extension assembly has means for permitting access to a gas adjustment fitting without removing said handguard extension assembly if a gas adjustment fitting is connected to said gas tube.

14. The firearm barrel change apparatus of claim 13 wherein said means for permitting access to a gas adjustment fitting without removing said handguard extension assembly if a gas adjustment fitting is connected to said gas tube comprises an opening in the hollow handguard extension tube of said handguard extension assembly.

15. The firearm barrel change apparatus of claim 1 wherein said receiver is an M-16 type receiver.

* * * * *